US006024240A

United States Patent [19]

Howard et al.

[11] Patent Number: 6,024,240

[45] Date of Patent: Feb. 15, 2000

[54] WASTEBASKET

[75] Inventors: Susan E. Howard, Richmond; Daniel E. Sabourin, Port Coquitlam, both of Canada

[73] Assignee: JRS Amenities Ltd., Richmond, Canada

[21] Appl. No.: 09/157,528

[22] Filed: Sep. 21, 1998

[30] Foreign Application Priority Data

Jun. 15, 1998 [CA] Canada ..... 2240699

[51] Int. Cl.[7] ..... B65D 90/04

[52] U.S. Cl. ..... 220/495.11; 220/909

[58] Field of Search ..... 220/495.06, 495.08, 220/495.1, 507, 909

[56] References Cited

U.S. PATENT DOCUMENTS

| | | | |
|---|---|---|---|
| D. 345,239 | 3/1994 | Cooper . | |
| D. 347,923 | 6/1994 | Martin et al. . | |
| 3,720,346 | 3/1973 | Cypher . | |
| 4,834,253 | 5/1989 | Crine . | |
| 4,834,262 | 5/1989 | Reed | 220/909 |
| 4,867,328 | 9/1989 | McCarthy | 220/909 |
| 4,874,111 | 10/1989 | Heller . | |
| 4,913,308 | 4/1990 | Culbertson . | |
| 4,974,746 | 12/1990 | Dickinson | 220/909 |
| 4,991,737 | 2/1991 | Edelman . | |
| 5,058,763 | 10/1991 | Dickinson | 220/909 |
| 5,085,342 | 2/1992 | Strawder . | |
| 5,190,183 | 3/1993 | McNaughton et al. | 220/909 |
| 5,310,078 | 5/1994 | Strawder | 220/909 |
| 5,320,241 | 6/1994 | Evans | 220/909 |
| 5,366,189 | 11/1994 | Thompson . | |

*Primary Examiner*—Joseph M. Moy
*Attorney, Agent, or Firm*—Oyen Wiggs Green & Mutala

[57] ABSTRACT

A wastebasket has a divider for dividing it into several sections for holding different kinds of trash for recycling. The wastebasket has a rim, notches in the rim, and a bag support member which, together, support a bag in each section of the wastebasket. For use in emptying trash from each section, the wastebasket has a removable lid which covers all but one section at a time.

5 Claims, 3 Drawing Sheets

WASTEBASKET

TECHNICAL FIELD

This invention pertains to a sectionalized wastebasket, and, more particularly, to a wastebasket intended for collecting trash in separate sections for recycling, and having novel means for supporting a bag in each section of the wastebasket.

BACKGROUND

In order to facilitate the collection and separation of recyclable trash, it is desirable that different kinds of trash be collected separately from each other to eliminate the need to sort or separate them later. For example, it is desirable that glass, metal cans, plastic, paper, or the like, be discarded into separate containers, or into separate sections of a single container, for convenient collection for recycling, since these different kinds of trash are processed separately during recycling. For use in hotel or motel rooms, homes, and similar places, it is often not convenient to have a number of separate wastebaskets for each principal kind of recyclable trash; it is preferable to have a single container divided into sections, one for each kind of trash that is to be collected and recycled. To facilitate the removal of the trash from each such section of a divided container, it is useful to line each section with a bag that can be removed from the section when it is desired to empty the wastebasket. Such bags are preferably thin-walled disposable plastic bags. Such bags are not self-supporting and it is desirable that they be supported upright and open in the sections of the wastebasket in order to receive the trash and permit easy removal. The present invention is directed to a wastebasket which holds the bags upright and open in each section thereof.

SUMMARY OF INVENTION

The invention is a sectionalized wastebasket which can support a bag for holding trash in each of the sections thereof. The body of the wastebasket is a container having side walls and a bottom wall. A rim extends outwardly around the top of the side walls, having a plurality of notches therein spaced around the rim. The wastebasket has a divider for dividing the container into a plurality of sections. The divider comprises a plurality of generally vertical walls which extend radially outward from a vertical axis at a central region of the container to the side walls thereof, adjacent the notches. A bag support member extends upwardly from the divider walls at an upper end of the vertical axis. This structure permits a bag having flexible walls to be supported within each of the sections of the container, by fitting the walls of the bag over the bag support member, around a section of the rim and into notches in the rim.

The divider is preferably X-shaped in cross-section, dividing the container into four sections.

The wastebasket may include vertically-extending grooves on an inner side of the side walls to receive the walls of the divider.

The wastebasket may further include a lid for the container, the lid having engaging means to engage on the bag support member, holding the lid on the container. The lid is preferably configured to cover all but one section of the container, permitting the wastebasket to be emptied one section at a time, by inverting it.

DESCRIPTION

Figure 1:
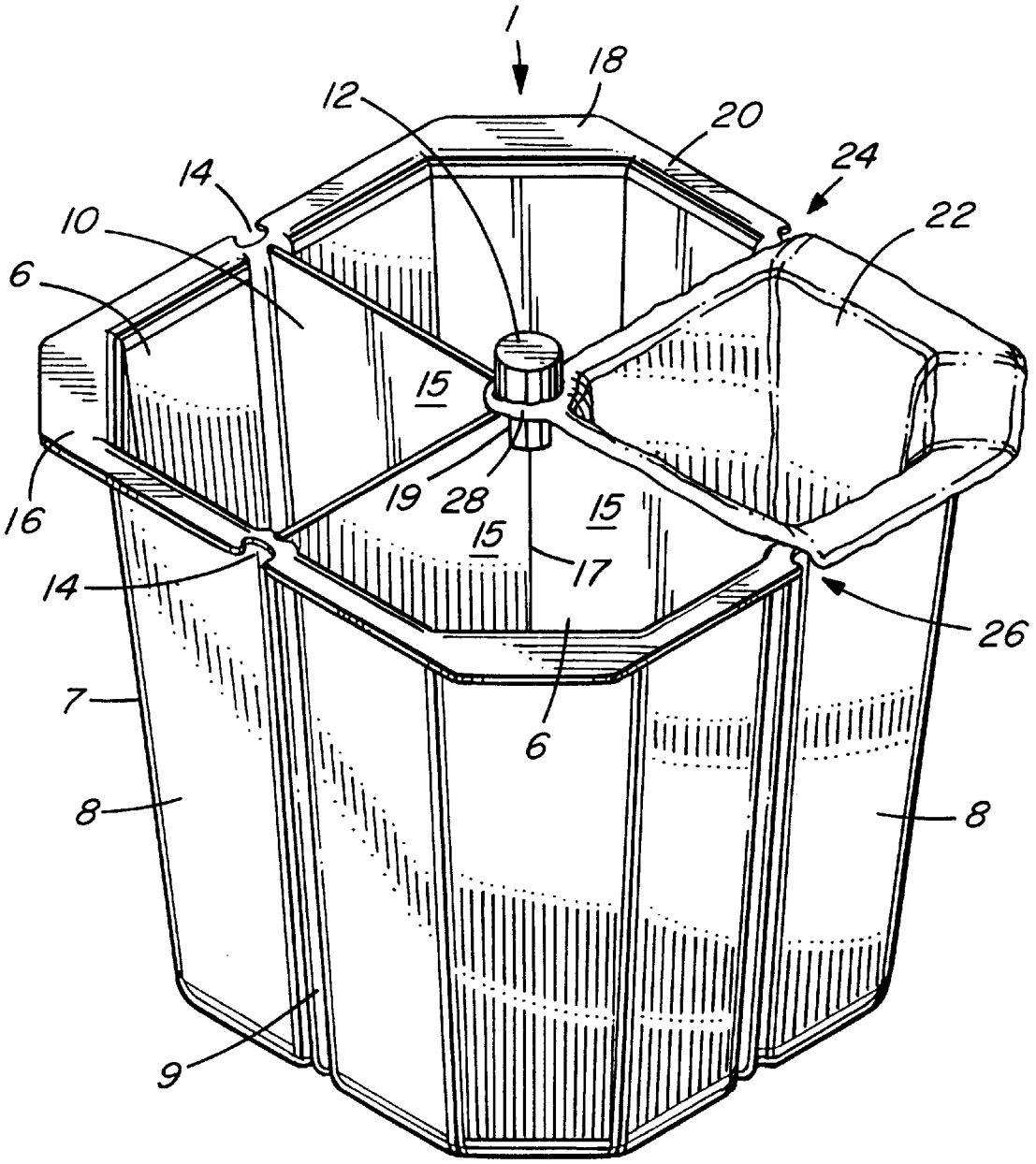
FIG. 1 is a perspective view of a wastebasket according to the invention.
Figure 2:
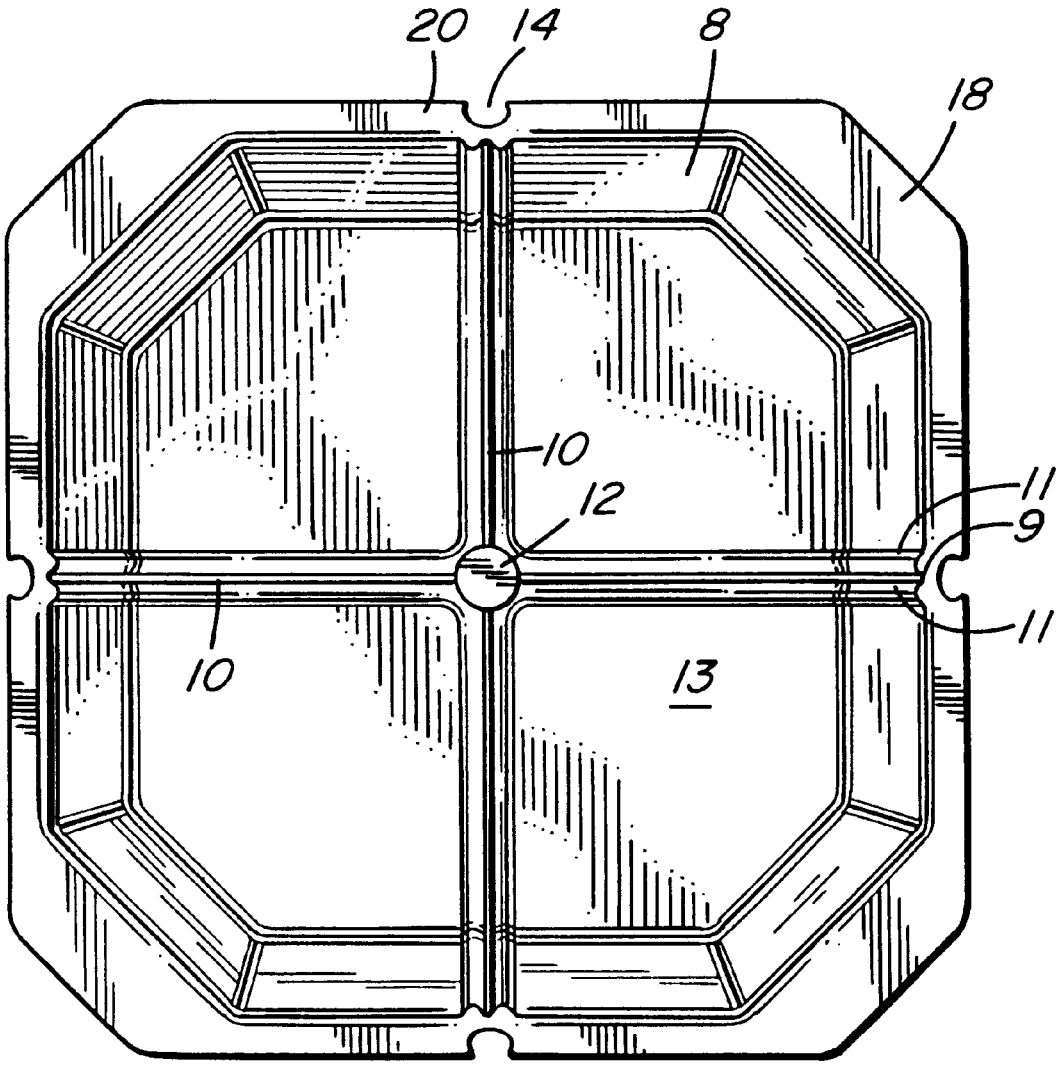
FIG. 2 is a top plan view thereof.

Wastebasket 1 comprises container 7 with divider 10 therein dividing the wastebasket into four sections 6. Container 7 has side walls 8 and bottom wall 13. It is generally octagonal in cross-section with alternating narrow and wide side wall sections. The side walls taper outwardly somewhat in the upward direction. The container may be made of any suitable material, for example PVC, and may be fabricated by injection molding.

The side walls 8 have an outwardly-extending rim 16 at their upper edge. The rim 16 has relatively wider sections 18, above each of the relatively narrower side wall sections, and relatively narrower sections 20 above the relatively wider side wall sections. Labelling, such as "Glass", "Plastic", "Cans", "Paper", or the like can be affixed to the wider sections 18 of the rim to indicate the type of trash intended to be put in each section. There are four C-shaped notches 14 in the rim, one at the middle of each narrower section 20 of the rim.

The side walls 8 have vertical grooves 9 therein, extending from the top edge of the side walls at the location of each notch 14 to receive the divider, as discussed below. The grooves may extend across the bottom wall 13 to receive the lower edge of the divider. The grooves 9 are formed by parallel and closely spaced ridges 11 in the walls of the container, which project inwardly forming groove 9 therebetween.

Figure 3:
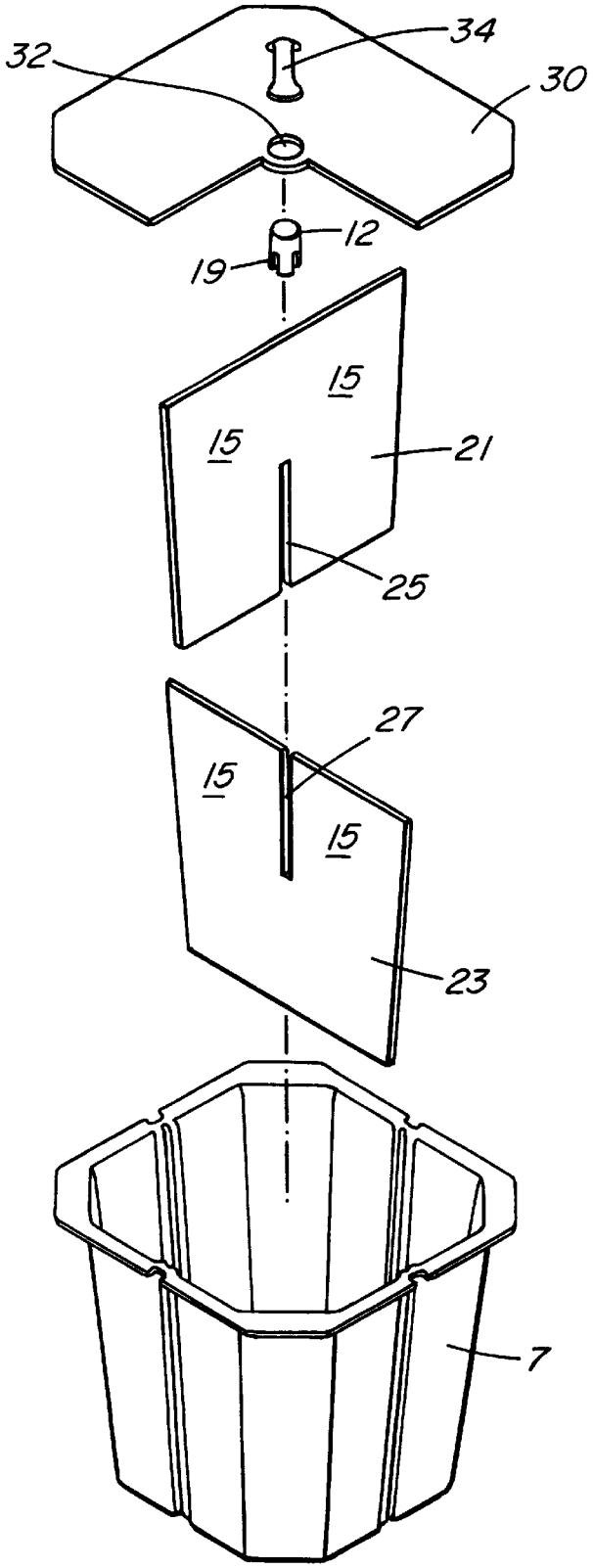
FIG. 3 is an exploded view of the components of the wastebasket, including the lid.

Divider 10 comprises four divider walls 15 which abut along a vertical axis 17 at the radially central position in the container 7. The divider 10 is preferably removable to facilitate cleaning of the container. As shown in FIG. 3, the divider comprises two interlocking members 21, 23, each of which forms two opposite walls 15, and which connect by means of the interfitting groove 25 of member 21 and groove 27 of member 23. Each of grooves 25 and 27 extends vertically halfway through its respective interlocking member 21, 23, and is wide enough to receive the body of the opposite member, so that the two interlocking members fit together to form the X-shaped divider 10. The radially outer edge of each divider wall 15 fits into a groove 9 in the side walls 8, retaining the divider in position in the container 7.

Bag support member 12 is a post that extends upwardly above the level of the rim 18 from the axis of intersection of the divider walls 15. Channels 19 in the lower side of the bag support member 12 form an X-shaped groove which fits over the upper edge of the divider walls 15, at their point of intersection. It may be held in place by adhesive.

FIG. 1 shows one disposable trash bag 22 in position in one of the sections 6 of the wastebasket. Bag 22 is a thinwalled plastic bag with an open top. It is of a size that fills the section and fits snugly when installed therein. It preferably has a round hole therein adjacent to its top edge, forming a loop 28 between the hole and the top edge of the bag. The bag is installed in the wastebasket by placing it into a section 6 and the top edge of the bag is fitted over rim 16 and into two of the notches 14, indicated at 24 and 26 in FIG. 1. The hole in the bag 22 adjacent its top edge is fitted over the bag support member 12, with the loop 28 of the bag looping around bag support member 12.

The bag can be removed, when it is desired to empty the wastebasket, by reversing the foregoing steps.

In use, four bags 22 are installed, one in each section 6 of the wastebasket. Bag support member 12 is of sufficient height to have four bags 22 looped over it.

Referring next to FIG. 3, which is an exploded view of the components of the wastebasket 1, the wastebasket preferably has a lid 30 which is configured to cover three of the four sections when it is placed on the container 7. Lid 30 has a handle 34 and an opening 32 which is sized and positioned to fit over bag support member 12 when the lid is placed on the wastebasket, in order to hold the lid in place and permit it to be conveniently rotated to uncover each section 6 of the container, one at a time, without removal of the lid from the wastebasket. The purpose of such lid is to permit the basket to be emptied, one section at a time, by inverting the wastebasket while holding the lid in place covering three sections, rather than by emptying it by removing the bags 22. This method of emptying the wastebasket is desirable if the user does not wish to remove and discard the bags when emptying trash from the wastebasket. It is not intended that such lid would be left on the wastebasket when it is not being emptied.

The preferred embodiment of the invention is described above, but it will be apparent that various modifications can be made to the wastebasket without departing from the scope of the invention. For example, the wastebasket can have more or fewer than four sections, and the sections can be of unequal sizes. Also, the bag 22 need not have a per-punched hole therein to fit over the bag support member. A simple slit near the edge of the bag that can be opened to form a hole that fits over the bag support member is sufficient; or the bag support member can be configured so that it can puncture a hole in the bag, for example by having a relatively pointed top instead of a flat one. The container can have any of a variety of cross-sectional shapes, for example round, oval, square or rectangular. It can be made of various materials and need not be smooth walled; for example it can be made of wicker. Also, the grooves 9 which retain the edges of the divider walls can be omitted if the divider and container are of an appropriate size and shape so that the divider fits snugly, particularly if the container walls are not smooth, for example if the container is made of wicker. Further, a lid that covers all the sections of the wastebasket can be provided so that trash in the wastebasket is concealed. The walls of the divider need not be solid; they can, for example, be made of metal grillwork or rods or the like, so long as they are sufficient to keep trash in one section of the wastebasket from falling into an adjacent section.

What is claimed is:

1. A sectionalized wastebasket which can support a bag for holding trash in each of the sections thereof, comprising:

(a) a container having side walls and a bottom wall;

(b) a rim extending outwardly around the top of said walls, said rim having a plurality of notches therein spaced about said rim;

(c) a divider for dividing said container into a plurality of sections, said divider comprising a plurality of generally vertical walls which extend radially outward from a vertical axis at a central region of said container to the side walls thereof, adjacent said notches;

(d) a bag support member extending upwardly from said divider walls at an upper end of said vertical axis;

(e) whereby a bag having flexible walls can be supported within each of said sections of said container by fitting said walls of said bag over said bag support member, around a portion of said rim and into notches in said rim.

2. A wastebasket according to claim 1 wherein said divider is X-shaped in cross-section and divides said container into four sections.

3. A wastebasket according to claim 1 further including vertically-extending grooves on an inner side of said side walls to receive said vertical walls of said divider.

4. A wastebasket according to claim 1 further including a lid for said container, said lid having engaging means to engage said bag support member, whereby said lid is held on said container.

5. A wastebasket according to claim 4 wherein said lid is configured to cover all but one section of said container.

* * * * *